United States Patent [19]

Dolenc et al.

[11] Patent Number: 4,513,714

[45] Date of Patent: Apr. 30, 1985

[54] METHOD OF ADJUSTING A PLURALITY OF FUEL INJECTION UNITS ASSOCIATED WITH RESPECTIVE CYLINDERS OF A MULTI-CYLINDER DIESEL ENGINE

[75] Inventors: Anton Dolenc, Vienna; Leopold Rollenitz, Kirchstetten, both of Austria

[73] Assignee: Steyr-Daimler-Puch Aktiengesellschaft, Vienna, Austria

[21] Appl. No.: 462,098

[22] Filed: Jan. 28, 1983

[30] Foreign Application Priority Data

Feb. 3, 1982 [AT] Austria ..... 393/82

[51] Int. Cl.[3] ..... F02M 59/20

[52] U.S. Cl. ..... 123/357; 123/501; 123/425

[58] Field of Search ..... 123/357–359, 123/501, 502, 425, 435, 494; 73/119 A

[56] References Cited

U.S. PATENT DOCUMENTS

| | | | |
|---|---|---|---|
| 3,638,628 | 2/1972 | Stolworthy | 123/198 R |
| 3,682,152 | 8/1972 | Muller-Berner | 123/357 |
| 4,327,688 | 5/1982 | Lowther | 123/501 |
| 4,397,285 | 8/1983 | O'Neill | 123/502 |

FOREIGN PATENT DOCUMENTS

| | | | |
|---|---|---|---|
| 364198 | 2/1981 | Austria . | |
| 2537219 | 3/1977 | Fed. Rep. of Germany . | |
| 2706731 | 8/1978 | Fed. Rep. of Germany . | |
| 2305605 | 10/1976 | France . | |
| 46073 | 3/1980 | Japan | 123/502 |
| 6030 | 1/1981 | Japan | 123/502 |
| 956859 | 4/1964 | United Kingdom . | |
| 2091447 | 7/1982 | United Kingdom | 123/501 |

*Primary Examiner*—Magdalen Y. C. Moy
*Attorney, Agent, or Firm*—Kurt Kelman

[57] ABSTRACT

A method of adjusting a plurality of fuel injection units associated with respective cylinders of a multi-cylinder diesel engine having a crankshaft operatively connected to all said cylinders is provided. Each of said fuel injection units comprises a fuel injection nozzle, a fuel injection pump connected to said nozzle and operable to discharge fuel therethrough, drive means for driving said pump, a housing accommodating said nozzle, said pump and said drive means, a capacity control element for controlling the capacity of said pump, and a timing control element for controlling the time at which said pump begins to discharge fuel through said nozzle. Said method is carried out with the aid of first sensor means connected to said engine and adapted to generate output signals representing the pressure in each of said cylinders, second sensor means connected to said engine and adapted to generate output signals representing the rotational position of said crankshaft, and indicating means connected to said first and second sensor means to receive their output signals and adapted to indicate for each of said cylinders the peak value of said pressure and the rotational position of said crankshaft at which said pressure begins to rise as a result of said combustion. Each of said fuel injection units is mounted on and operatively connected to the associated cylinder of said engine, said engine is operated under idling conditions to effect a combustion of fuel in each of said cylinders and said first control element of each of said fuel injection units is adjusted so that the pressure in each of said cylinders rises to the same peak value as a result of said combustion. Said engine is subsequently operated to effect a combustion of fuel in each of said cylinders and said second control element of each of said fuel injection units is adjusted so that said pressure in each of said cylinder begins to rise when said crankshaft is in a predetermined rotational position desired for the beginning of said combustion.

2 Claims, 1 Drawing Figure

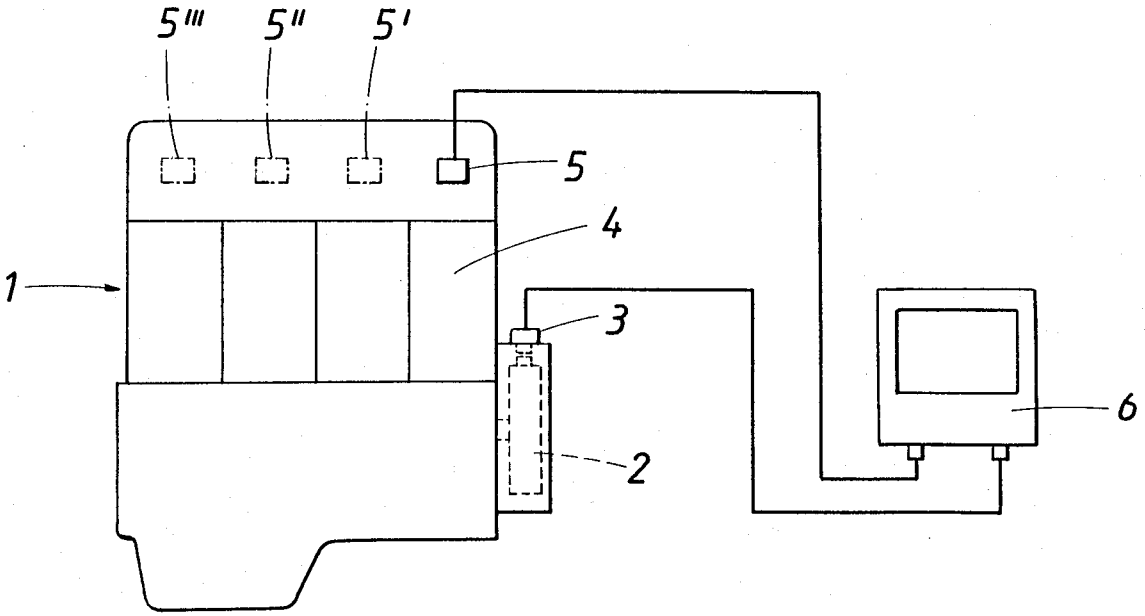
1
5'''
5''
5'
5
4
3
2
6

METHOD OF ADJUSTING A PLURALITY OF FUEL INJECTION UNITS ASSOCIATED WITH RESPECTIVE CYLINDERS OF A MULTI-CYLINDER DIESEL ENGINE

This invention relates to a method of adjusting a plurality of fuel injection units associated with respective cylinders of a multi-cylinder diesel engine, each of which units comprises a fuel injection nozzle and a fuel-injecting piston pump, which together with the nozzle is accommodated in a common housing and comprises drive means, a capacity control element for controlling the capacity of the pump, and a timing control element for controlling the beginning of the fuel injection, in which method at least one sensor for an indirect or direct detection of the pressure in the combustion cylinder in each cylinder of the engine and a sensor for detecting the rotational position of the crankshaft are used, which sensors are operatively connected to an appliance for plotting the pressure in the combustion chamber in each cylinder against the rotational position of the crankshaft.

In multi-cylinder diesel engines, the fuel-injecting units are usually actuated by a camshaft through the intermediary of rocker arms and respective tappets, which are longitudinally adjustable. To permit an adjustment of the quantity of fluid delivered by the fuel injection pump per stroke thereof, the piston of said pump is rotatable by means of a rod, which is secured to the piston and in mesh with a control rack. As soon as the end face of the pump piston has moved beyond an opening which communicates with a fuel reservoir, the interior of the pump will be closed and the fuel will be injected through the nozzle orifice into the combustion chamber when the pressure has risen to a sufficiently high value. The pump piston is formed with an oblique control edge and with a longitudinal groove leading from said control edge to the end face of the piston. When the control edge has moved to expose the connecting opening, fuel is free to escape from the pressurized interior of the pump or nozzle into the fuel reservoir so that the injection of fuel is then interrupted. The beginning of the injection can be changed by a longitudinal adjustment of the tappet which connects the pump piston to the rocker arm.

It is difficult to adjust each fuel injection unit of the engine so that the fuel injection begins at the time which is appropriate for an effective combustion and which is the same for all engine cylinders and that a uniform quantity of fuel is injected into each cylinder, as is required to ensure a smooth running of the engine. In a known method, each fuel injection unit is adjusted on a pump test stand to inject a desired quantity of fuel per stroke of the pump. For this adjustment, the capacity control element of the pump is adjusted, i.e., the pump piston is rotated by means of the control rod and is fixed in its adjusted position. The fuel injection unit is then installed in the engine and the timing control element is adjusted in that the length of the tappet is changed in such a manner that the end face of the pump piston has just moved beyond the connecting opening in the wall of the pump cylinder when the crankshaft is in the rotational position desired for the beginning of the combustion so that the discharge stroke of the fuel injection pump begins at that time. For this adjustment, a gage is applied to a reference surface of the fuel injection unit. That gage determines the distance between said reference surface and the surface of the spring abutment for the piston-biasing spring, which spring abutment is secured to the pump piston. That distance depends on the dimensions of the components of the fuel injection unit. The end face of the pump piston can then be moved to the required position relative to the connecting opening in the cylinder wall, which is firmly connected to the reference surface. That method has the disadvantage that the large number of cooperating parts of the unit results in a very long series of tolerances so that a high total tolerance is involved in the distance determined by means of the gage and results in inaccuracies regarding the actual position of the end face of the pump piston relative to the connecting opening so that the beginning of the fuel injection can vary greatly and the combustion process may be adversely affected. Besides, the fixing of a fuel injection unit to the cylinder head may result in uncontrolled distortion of the housing of the fuel injection unit. That distortion may increase the inaccuracies. Moreover, the proper application of the gage depends on the sense of touch of the worker so that the adjustments vary greatly. Finally, the adjustment of the capacity of the pump of each fuel injection unit on the test stand for the fuel injection pumps is expensive and the pump capacities may differ somewhat for different fuel injection units owing to tolerances of the test stand.

It is known to provide sensors for measuring the pressure in the combustion chamber and for detecting the rotational position of the crankshaft and to connect these sensors to an appliance for plotting the pressure in the combustion chamber against the rotational position of the crankshaft (British Patent Specification No. 956,859). That arrangement has been used only for the detection of a knocking process during a plurality of revolutions of the crankshaft. In accordance with Laid-open German Application No. 25 37 219, the end of the fuel injection rather than the pressure in the combustion chamber is detected. This is also true for the method disclosed in Laid-open German Application No. 27 06 731, with the difference that the values which have been measured can be used for an adjustment of each fuel injection pump for an optimum timing of the end of the fuel injection. In accordance with French Patent Specification 2,305,605, a sound sensor is used to indicate the impact of the pintle of the nozzle on its stop so that the beginning of the fuel injection can be more properly controlled.

It is an object of the invention to provide a method by which the beginning of the fuel injection which is required for an exactly predetermined combustion process can be adjusted regardless of manufacturing tolerances and of the worker's skill and the capacity of the fuel injection pump can be directly adjusted when the fuel injection unit has been mounted on the engine and without need for a separate test stand for fuel injection pumps.

This object is accomplished according to the invention in that the pump capacity at idle is adjusted for all fuel injection units in that the peak pressures resulting in the combustion chambers of all cylinders from the combustion are adjusted to the same value by means of the capacity control elements and the pressure rise in the combustion chamber of each cylinder is adjusted by means of the timing control element to begin at the desired rotational position of the crankshaft.

The pump capacities can be adjusted in a particularly quick and exact manner if the pump capacity of each fuel injection unit is adjusted to a predetermined pump capacity. As the pressure in the combustion chamber and the rise of said pressure depend on the pump capacity, it is sufficient to compare the indicated pressure in each combustion chamber with the desired value of such pressure so that there will be no longer a need for a subsequent joint adjustment of all fuel injection units to the proper idling speed.

The sensor for measuring the pressure in the combustion chamber may consist of a pressure sensor inserted in a sensing bore. For this reason the method of the invention can be carried out by means of apparatus which is particularly simple in structure and operation and which comprises at least one sound sensor which is used to measure the pressure in the combustion chambers and is arranged to receive signals associated with respective engine cylinders. Such sound sensors can readily be applied to the outside of each cylinder. Alternatively, a single sound sensor may be applied in succession to several cylinders of the engine for the adjustment of the respective fuel injection units. The plotter may consist of a two-beam oscilloscope, by which the change of the combustion chamber in each cylinder is displayed so that the pump capacities of all fuel injection units can be adjusted to the same value. The oscilloscope displays also a mark indicating the rotational position of the crankshaft which is desired at the beginning of the combustion and it is apparent at what rotational position the pressure in each combustion chamber begins to rise as a result of the beginning of the combustion. From these indications the difference between the desired and actual crank angles can be read and can be eliminated by a proper adjustment of the connecting tappet. Instead of the oscilloscope, digital electronic counters may be used for a direct numerical indication of the differential crank angle.

Apparatus for carrying out the method according to the invention is strictly diagrammatically shown on the drawing.

A sensor 3 for detecting the rotational position of the crankshaft is mounted on the flywheel 2 of a four-cylinder diesel engine 1. A sound sensor 5 is secured to the cylinder head of one cylinder 4 and can subsequently be applied to the remaining cylinders in positions 5', 5'' and 5'''. A two-beam oscilloscope 6 is connected to receive the outputs of the sensor 3 for sensing the rotational position of the crankshaft and the output of the sound sensor 5. For a given engine speed the oscilloscope 6 displays a mark for the crank angle which is desired at the beginning of the combustion. The oscilloscope plots the pressure in the combustion chamber of the respective cylinder 4 against the rotational position of the crankshaft so that the beginning of the rise of the pressure in the combustion chamber as a result of the beginning of the combustion therein is apparent. The peak of the curve which represents the pressure in the combustion chamber may be regarded as a measure of the capacity of the fuel injection pump of the fuel injection unit associated with the cylinder 4. The capacity control element is then so adjusted that the peak of the curve has a predetermined value, which is the same for all cylinders, so that the fuel injection pumps associated with all cylinders have the same capacity. Finally, the timing control element for controlling the beginning of the fuel injection is so adjusted that the beginning of the pressure rise in the combustion chamber which is due to the combustion agrees with the desired value indicated by the mark.

What is claimed is:

1. A method of adjusting a plurality of fuel injection units associated with respective cylinders of a multi-cylinder diesel engine having a crankshaft operatively connected to all said cylinders, each of said fuel injection units comprising a fuel injection nozzle, a fuel injection pump connected to said nozzle and operable to discharge fuel therethrough, a housing accommodating said nozzle and said pump, drive means for driving said pump, a capacity control element for controlling the capacity of said pump, and a timing control element for controlling the time at which said pump begins to discharge fuel through said nozzle, the steps of connecting first sensor means to said engine for generating output signals representing the pressure in each of said cylinders, connecting second sensor means to said engine for generating output signals representing respective rotational positions of said crankshaft, and connecting, indicating means to said first and second sensor means for receiving the output signals thereof and for indicating for each of said cylinders a peak value of said pressure and the respective rotational position of said crankshaft at which said pressure begins to rise as a result of a combustion of the fuel, wherein the improvement comprises mounting each of said fuel injection units on, and operatively connected to, the associated cylinder of said engine, operating said engine under idling conditions to effect the combustion of fuel in each of said cylinders and adjusting said capacity control element of each of said fuel injection units so that the pressure in each of said cylinders rises to the same peak value as a result of said combustion, and subsequently operating said engine to effect a combustion of fuel in each of said cylinders and adjusting said timing control element of each of said fuel injection units so that said pressure in each of said cylinder begins to rise when said crankshaft is in a predetermined rotational position desired for the beginning of said combustion.

2. The improvement set forth in claim 1, wherein said output signals of said first and second sensor means are delivered to a plotter for plotting said pressure in each of said cylinders against said rotational position in response to said output signals and for displaying a mark indicating said rotational position desired for the beginning of the combustion of fuel in each of said cylinders.

* * * * *